United States Patent [19]

Gregoris

[11] Patent Number: 4,782,354

[45] Date of Patent: Nov. 1, 1988

[54] AUTOMATIC PHOTOGRAPH DEVELOPING PLANT

[75] Inventor: Giuseppe Gregoris, Azzano Decimo PN, Italy

[73] Assignee: Gregoris Photo Equipment-ICAMA s.n.c., Azzano Decimo PN, Italy

[21] Appl. No.: 881,051

[22] Filed: Jul. 1, 1986

[30] Foreign Application Priority Data

Jul. 16, 1985 [IT] Italy ..... 83382 A/85

[51] Int. Cl.[4] ..... G03D 3/13

[52] U.S. Cl. ..... 354/322; 226/118; 242/55.01

[58] Field of Search ..... 354/319, 320, 321, 322; 226/118, 119; 242/55.01

[56] References Cited

U.S. PATENT DOCUMENTS

| | | | |
|---|---|---|---|
| 1,595,294 | 8/1926 | Moos | 226/119 |
| 1,631,476 | 6/1927 | Moos | 226/119 |
| 3,430,548 | 3/1969 | Jiruska | 354/319 |
| 3,501,076 | 3/1970 | Stuart et al. | 226/118 |
| 3,532,282 | 10/1970 | Wolff | 226/118 |
| 3,699,869 | 10/1972 | Jensen | 354/321 |
| 4,215,827 | 8/1980 | Roberts et al. | 226/118 |
| 4,561,235 | 12/1985 | Yanagisawa et al. | 355/27 |

*Primary Examiner*—A. A. Mathews

*Attorney, Agent, or Firm*—Leonard Bloom

[57] ABSTRACT

A plant for the continuous processing and developing of photosensitive material. A plurality of interface units are positioned "in-line" between various units in a line for automatically and continuously receiving said material from "up-line" units and continuously passing said material to "down-line" units. The interface units include a pair of separate groups of pulleys which are axially movable relative to one another.

15 Claims, 7 Drawing Sheets

AUTOMATIC PHOTOGRAPH DEVELOPING PLANT

FIELD OF THE INVENTION

The present invention relates to plants for developing processing photosensitive materials, and in particular to such a plant having a series of sequentially operational machines (units) for processing and developing positive and/or negative, black and white and/or color photographic and film material.

BACKGROUND OF THE INVENTION

Presently, while plants for the processing and developing of photosensitive materials such as film and photographic paper vary greatly, they usually employ a variety of machines (units) for each stage of the development process. Each of these machines (units), while being sequentially operational, are designed to operate independently of one another. Furthermore, each of these machines (units) requires a special operator and has various operational characteristics and speeds.

Unfortunately, the developing and processing plants described above, of which I am aware, suffer from various disadvantages due to the lack of continuity in the process (the "line") brought about by these various machines. For example, such plants require several operators to operate the various, diverse machines (units). Also, such plants often require that the photosensitive material being processed or developed be manually handled in order to effect the transference thereof from one machine (unit) to another. Such disadvantages not only increases the time and cost involved in the process (by requiring several operators) but also expose the photosensitive material to potential damage which results from the continuous manual handling thereof. Finally, this lack of continuity also makes it difficult and expensive to conduct reliable consistent and efficient inspections to insure quality of the process.

Thus, it will be appreciated that there remains a need for providing a plant ("line") for the continuous processing and developing of photosensitive materials in which a means is provided for maintaining the continuity of the process among the various machines (units) utilized therein.

SUMMARY OF THE INVENTION

The present invention is intended to solve the abovementioned disadvantages and thereby enable the realization of a plant (a "line") for the continuous developing and processing of photosensitive materials. The operation of such a plant ("line") may then be controlled and checked by central and peripheral data processors to insure the reliability and quality of the process ("line").

The advantages offered by the present invention are a reduction in the personnel required to operate the plant, a reduction of time and costs involved with the process, a reduction in the risk of damage to which the photosensitive material is exposed and a more constant, reliable and efficient control of the quality of the process in that centralized control of every machine (unit) of the process and the data input therefor may be effected.

The present invention solves the problems of the art by providing a plant for processing and developing photosensitive material which includes "in-line" interface units for receiving the photosensitive material from "up-line" developing and processing units of the plant and for passing said photosensitive material to further "down-line" developing or processing units of the plant.

Each of said "in-line" interface units consists of at least two separate and distinct groups of belt pulleys, each group being axially propositioned oppoed with respect to the other. Preferably, one group of said belt pulleys are arranged as upper pulleys. It is also preferred that, in such a case, the other group of said belt pulleys are arranged as lower pulleys.

Each of said individual pulleys is independently axially orientable. Each of said group of pulleys is mounted on separate independent support frames. Said support frames are selectively movable either towards or away from one another.

In accordance with the teachings of the present invention, there is disclosed a plant for the continuous development and processing of photosensitive materials. This plant includes a preslicing unit for the extraction and preslicing of photosensitive material, whereby a continuous strip of photosensitive material is formed. A leader magazine unit is positioned down-line of the preslicing unit for continuously receiving the continuous strip of photosensitive material therefrom and for continuously feeding the photosensitive material therefrom at a selected speed. A prechecking unit is positioned down-line of the magazine unit. This unit continuously prechecks the continuous material to be processed and developed. A first interface unit is positioned between the magazine unit and the prechecking unit, whereby the photosensitive material being continuously fed from the magazine unit is continuously received and is continuously passed to the prechecking unit. A continuous processing unit is positioned down-line of the prechecking unit for continuously processing the photosensitive material. A second interface unit is positioned between the prechecking unit and the processing unit, whereby the photosensitive material is continuously received from the prechecking unit and is continuously passed to the processing unit. A notching unit is positioned down-line of the processing unit. This unit continuously notches the processed photosensitive material, whereby side hint notches are continuously formed in the photosensitive material. A third interface unit is positioned between the processing unit and the notching unit, whereby the processed photosensitive material is continuously received from the processing unit and is continuously passed to the notching unit. A printer unit is positioned down-line of the notching unit. This unit provides for continuously exposing the photosensitive material to printing paper, whereby prints of the photosensitive material are continuously formed. A fourth interface unit is positioned between the notching unit and the printer unit. This fourth interface unit permits the processed, notched photosensitive material to be continuously received from the notching unit and continuously passed to the printer unit. A printing paper developing unit is positioned down-line of the printer unit. This developing unit continuously develops the prints of the photosensitive material, whereby prints of the photosensitive material are continuously developed. A fifth interface unit is positioned between the printer unit and the developing unit. This fifth unit permits the prints of the photosensitive material to be continuously received from the printer unit and to be continuously passed to the developing unit. An inspection station unit is positioned down-line of the developing unit for continuously inspecting the quality of the developed prints of photosensitive material. A sixth interface unit is positioned between the developing unit and the inspection station unit. This sixth unit permits the developed prints of photosensitive material to be continuously received from the developing unit and to be continuously passed to the inspection station unit. A sorting table unit is positioned down-line of the inspection station unit. This unit provides for continuously receiving, classifying, sorting and packing the inspected prints of the photosensitive material. Finally, a seventh interface unit is positioned between the inspection station unit and the sorting table unit. This seventh unit permits the inspected prints of photosensitive material to be continuously received from the inspection station unit and to be continuously passed to the sorting table unit.

In further accordance with the teachings of the present invention, each of the interface units includes a frame. A first support platform is positioned in a first plane on the frame. A second support platform positioned in a second plane on the frame. The second plane is substantially parallel to the first plane in which the first support platform is positioned. Means is provided for selectively moving at least one of the support platforms relative to the other support platform. In this fashion, the support platforms may be selectively moved in either a first direction towards one another or in a second direction away from one another. At least one first pulley is provided. Each of the first pulleys has a first mounting arm including a mounting portion having a first longitudinal axis which is substantially perpendicular to the first plane. The first mounting arm further includes a support portion having a second longitudinal axis which is substantially parallel to the first plane and which is further substantially perpendicular to the first longitudinal axis. The mounting portion of each first pulley is rotatably journaled in, and supported by, the first support platform for rotational movement about the first longitudinal axis. Each of the first pulleys further has a first sheave which is rotatably carried on and supported by the support portion thereof for rotational movement about the second longitudinal axis. At least one second pulley is provided. Each second pulley has a second mounting arm which includes a mounting portion having a first longitudinal axis which is substantially perpendicular to the second plane. The second mounting arm of each second pulley further includes a support portion having a second longitudinal axis which is substantially parallel to the second plane and is substantially perpendicular to the first longitudinal axis of the mounting portion of the second mounting arm. The mounting portion of each second pulley is rotatably journaled in, and supported by, the second support platform, for rotational movement about the first longitudinal axis of the mounting portion of the second mounting arm. Each of the second pulleys further has a second sheave which is rotatably carried on, and supported by, the support portion of the second mounting arm for rotational movement about the second longitudinal axis thereof. In this fashion, the photosensitive material is continuously received in a sheave of one of the first and second pulleys and is serpentinely wound on alternating first and second sheaves. Also, the photosensitive material is continuously received from an up-line unit of the line in one of the first and second sheaves. This material is also serpentinely wound on alternating first and second sheaves. Also, the photosensitive material is continuously passed form one of said first and second sheaves to a down-line unit of line. As a result, a plant having a line for the continuous development and processing of photosensitive materials is provided.

It is also preferred that the "in-line" interface units, as well as the processing and developing units be data interconnected and operationally controlled by one or more controlling data processors. Each processor may control one or more "lines".

These and other objects of the present invention will become apparent from a reading of the following specification taken in conjunction with the enclosed drawings.

DESCRIPTION OF PREFERRED EMBODIMENTS

Figure 1:
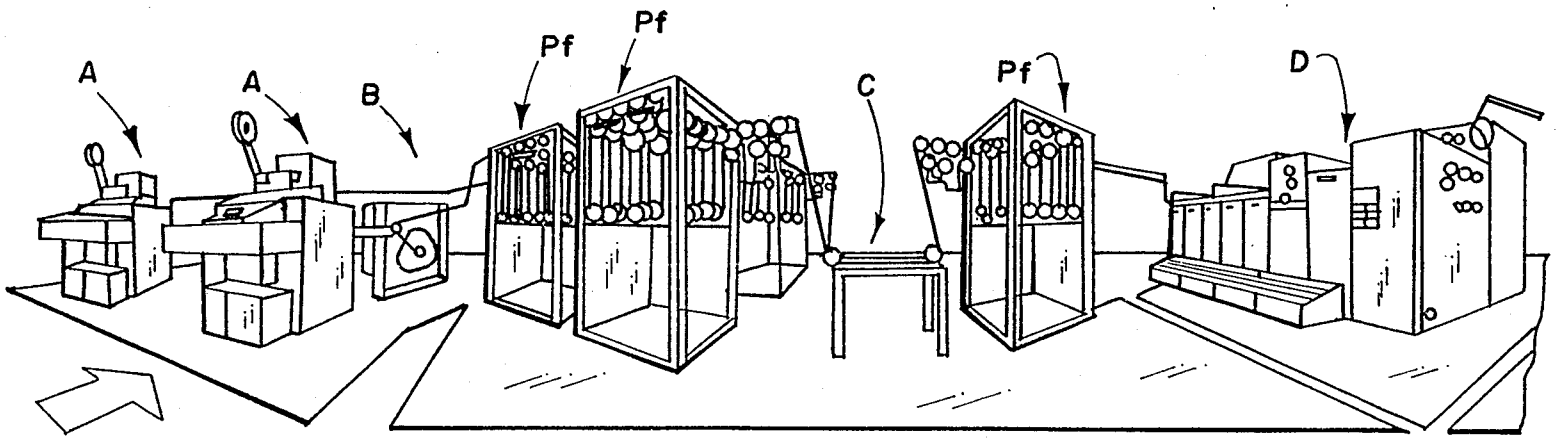
FIGS. 1, 2, and 3 schematically illustrate, in perspective, the beginning, intermediate and last portions, respectively, of a typical "line" of a plant up to the point of packing.
Figure 2:
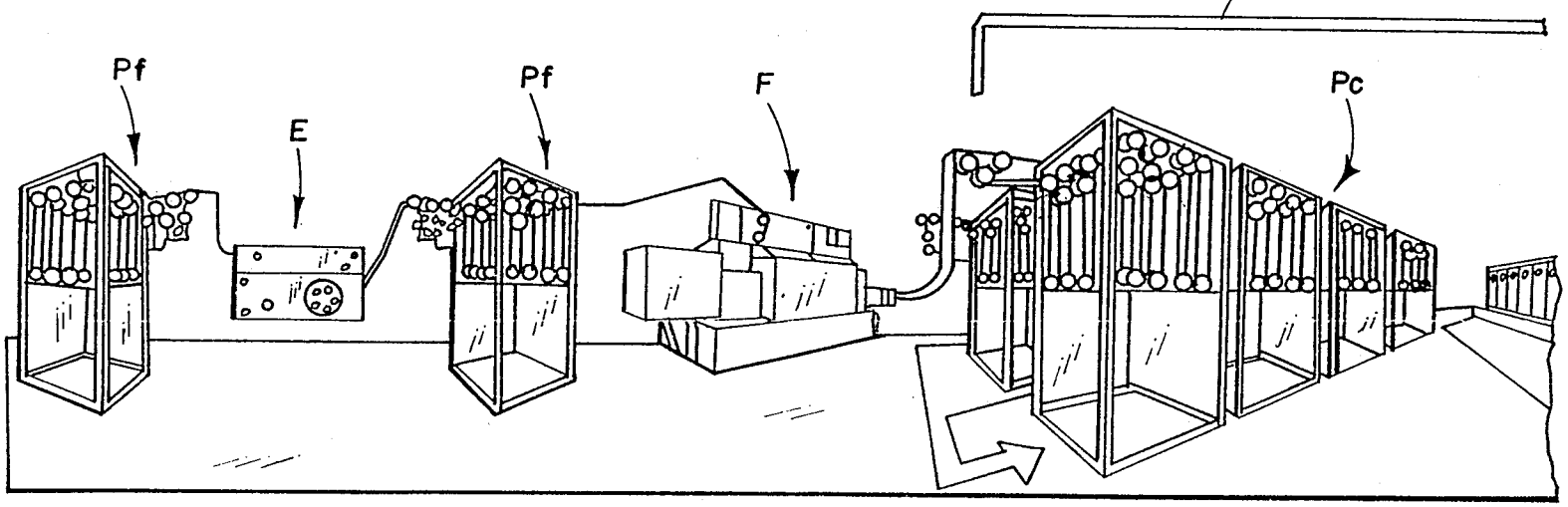
Figure 3:
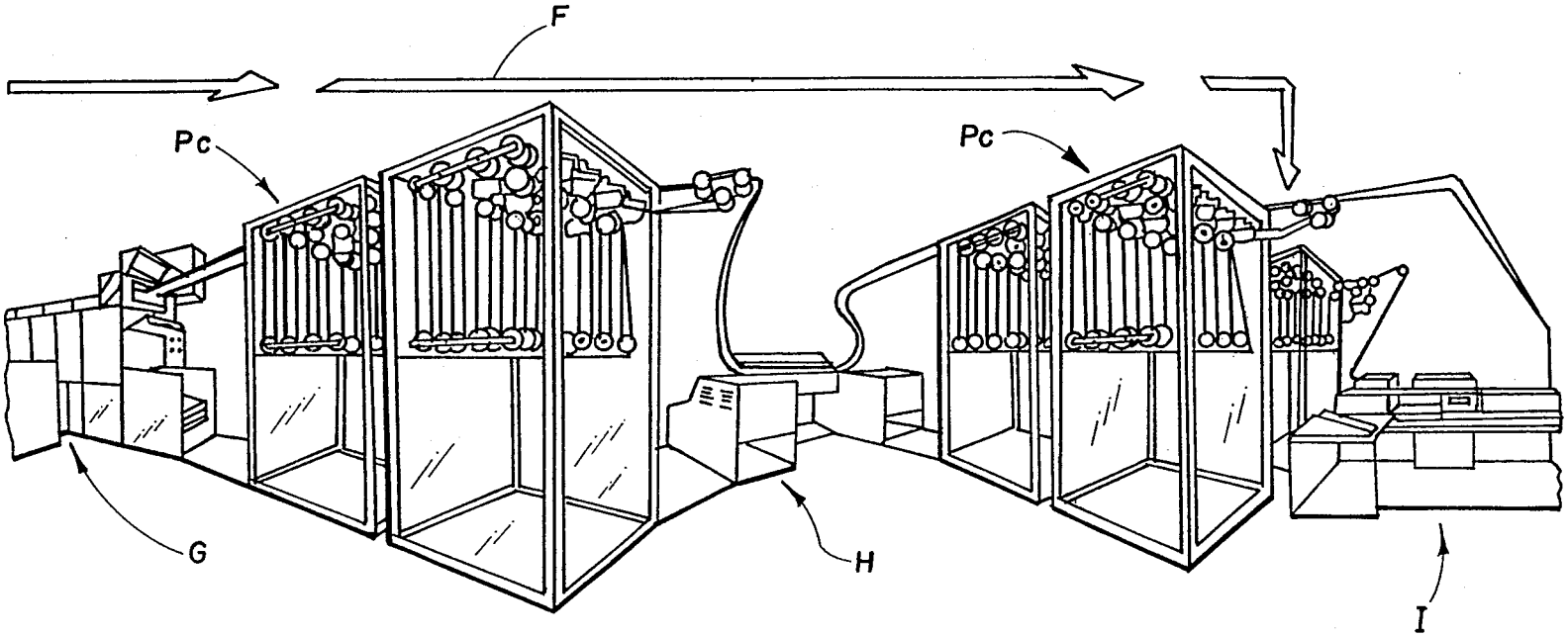
Figure 4:
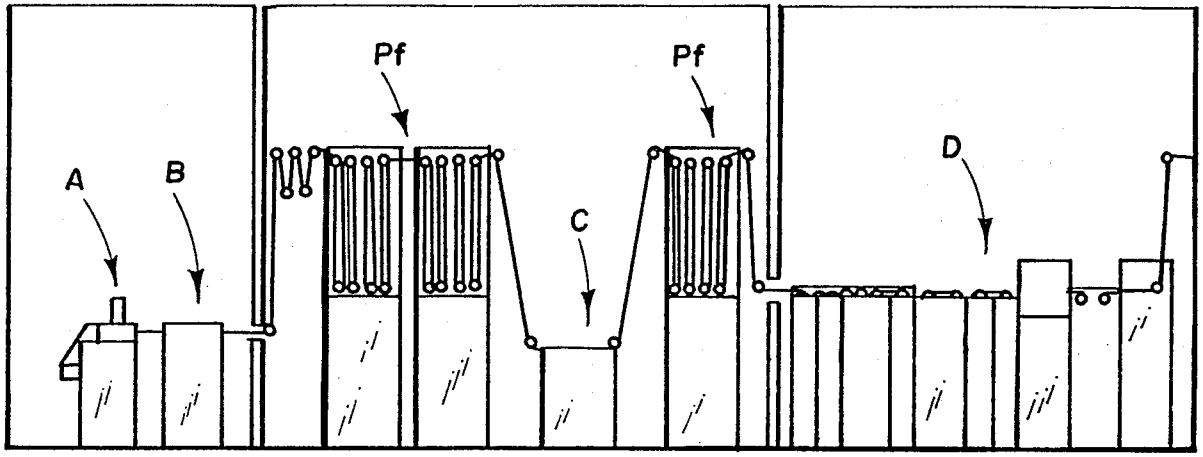
FIGS. 4 and 5 are, respectively, side and top schematic views of the beginning portions of the developing "line" of FIGS. 1–3.
Figure 5:
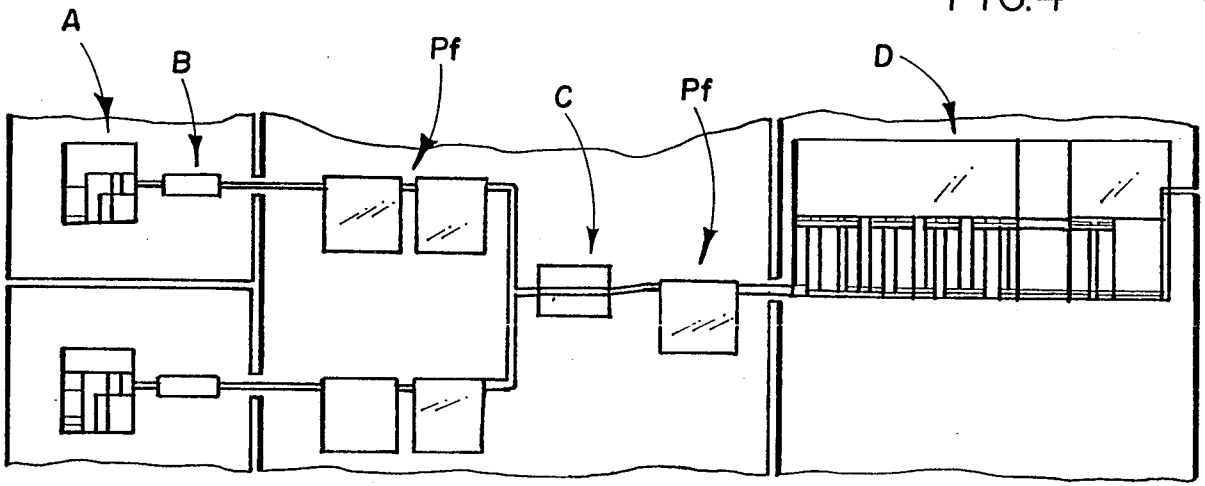
Figure 6:
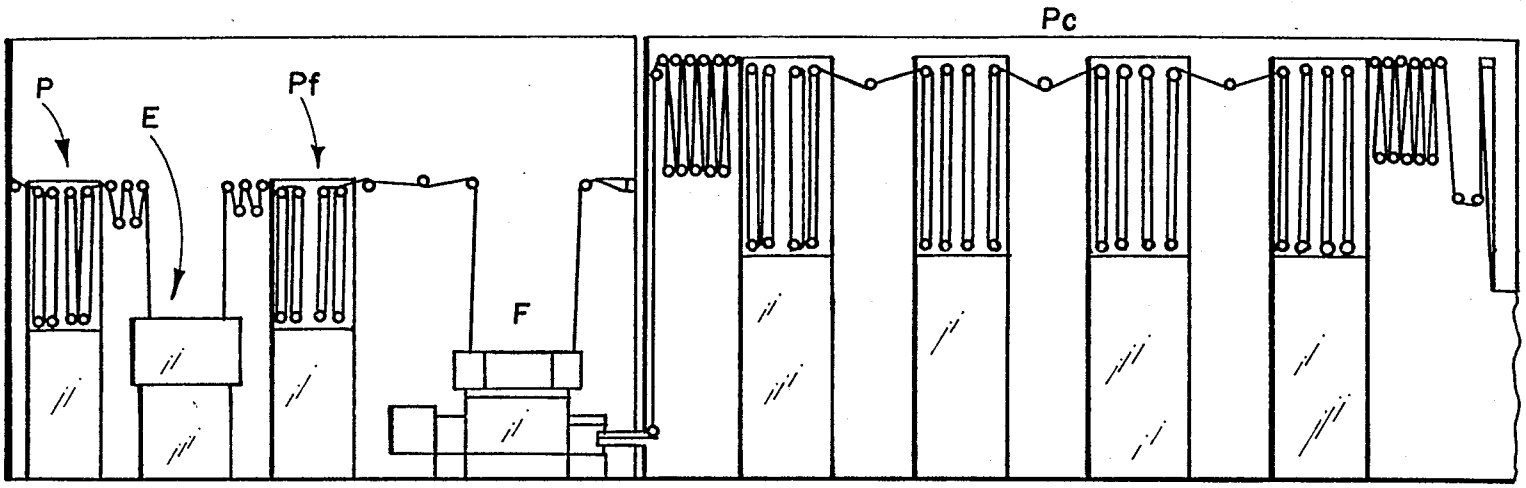
FIGS. 6 and 7 are, respectively, side and top schematic views of the intermediate portions of the developing "line" of FIGS. 1–3.
Figure 7:
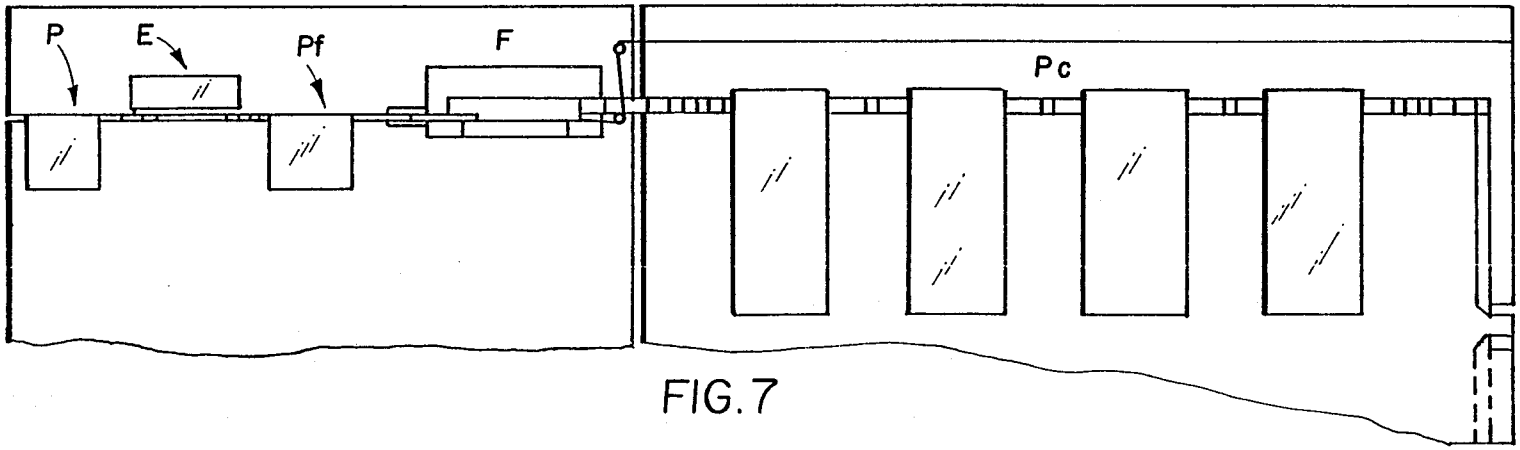
Figure 8:
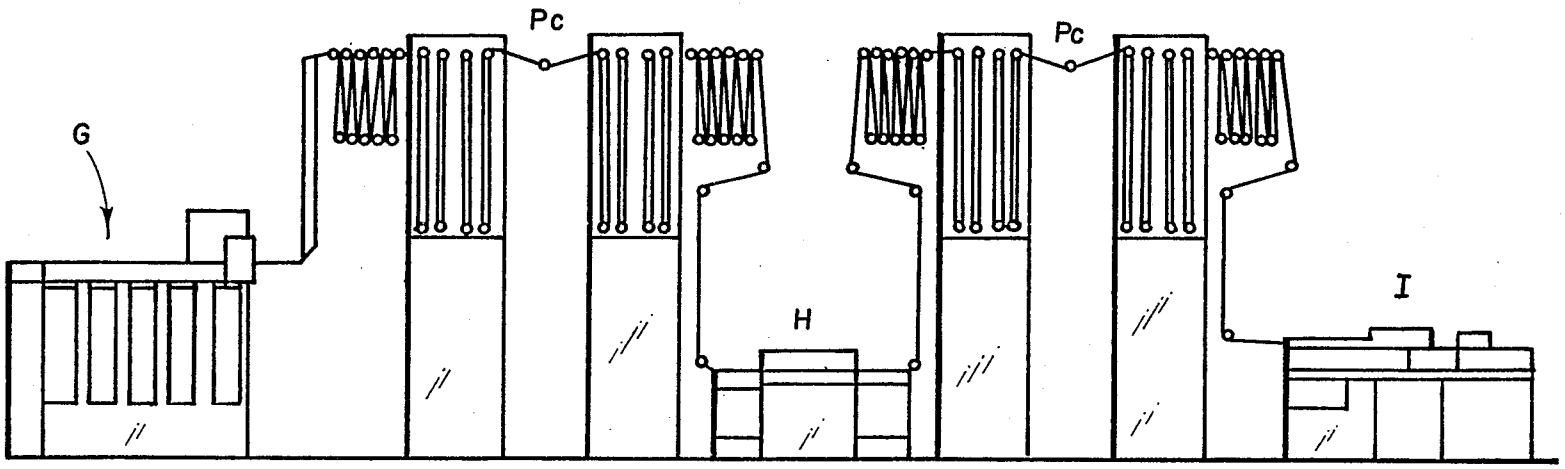
FIGS. 8 and 9 are, respectively, side and top schematic views of the last portion of the developing "line" of FIGS. 1–3.
Figure 9:
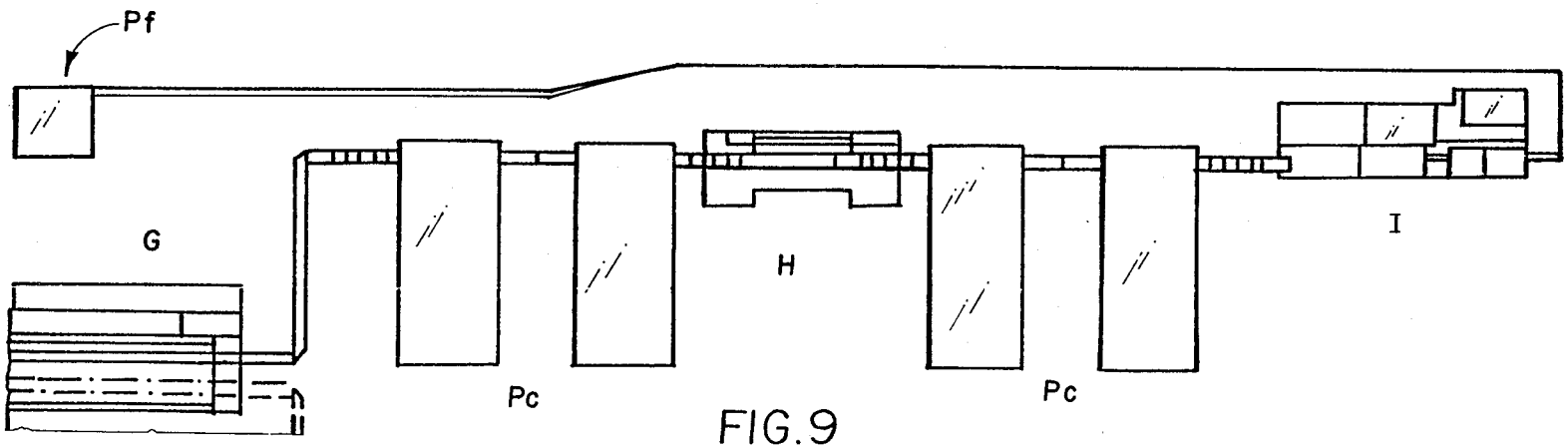

With reference now to the drawings and with particular reference to FIGS. 1–9, the present invention utilizes suitable and respective interface units Ps and Pf. Said interface units Pf and Ps are placed "in-line" between various developing and processing units A–I, which are employed in respective "lines" of a plant for processing and developing photosensitive material. Positioned thusly, each of said interface units Ps and Pf receives the photosensitive material from units of the plant "up-line" therefrom and passes this photosensitive material to units of the plant "down-line" therefrom.

The photosensitive material being processed and developed may be, for example, photographic film F and/or photographic paper C, which is stretched and wound in a serpentine fashion, Each line of the plant is comprised of a number of units which are commonly found in the art. These devices includes a preslicer A which is an extractor-preslicer machine which extracts, splices and forms a continuous strip of photosensitive material is formed. A leader magazine unit B is positioned "down-line" of the preslicing unit A and receives the continuous strip of photosensitive material therefrom. These magazine units feed the photosensitive material therefrom at a preselected speed.

A prechecker (prechecking unit) C is positioned "down-line" of the magazine unit. Prechecking unit C prechecks the material being processed and developed. A continuous film processor unit D which is well known to those skilled in the art, is positioned "down-line" from the prechecking unit C.

A notcher (notching unit) unit E is positioned "down-line" of the processor unit D. This unit E notches the side film f, whereby side hint notches are formed in the photosensitive material. These notches are provided in order to check the successive stages of the developing process image by image; these side notches may also be used to sort out the films before returning them to the customer.

A color printer unit F is positioned "down-line" of the notching unit E. This printer unit F exposes the paper C to the negative f. In this fashion, unit F forms prints of the photosensitive material.

A printing paper developing unit G is positioned "down-line" of the printer unit F. This developing unit G is, preferably, a high speed paper processor, for continuously developing prints of the photosensitive material.

A quality inspection station (inspection station unit) unit H is positioned "down-line" of the developing unit G. This unit H is a quality inspection station for inspecting the quality of the developed prints of photosensitive material and of the image printed on the paper C. Finally, a sorting table unit I is positioned "down-line" of the inspection station unit H. On this table unit I, the photos, film f and paper C are sorted, classified and packed.

Positioned between each of units B-I is a respective interface unit Pc and Pf. Interface units Pc and Pf continuously receive the photosensitive material from "up-line" units and continuously pass it to "down-line" units. In this fashion, the interface units Pc and Pf provides a means whereby the film F and paper C may be continuously and automatically passed between successive independently operative units A–I in the line.

Figure 10:
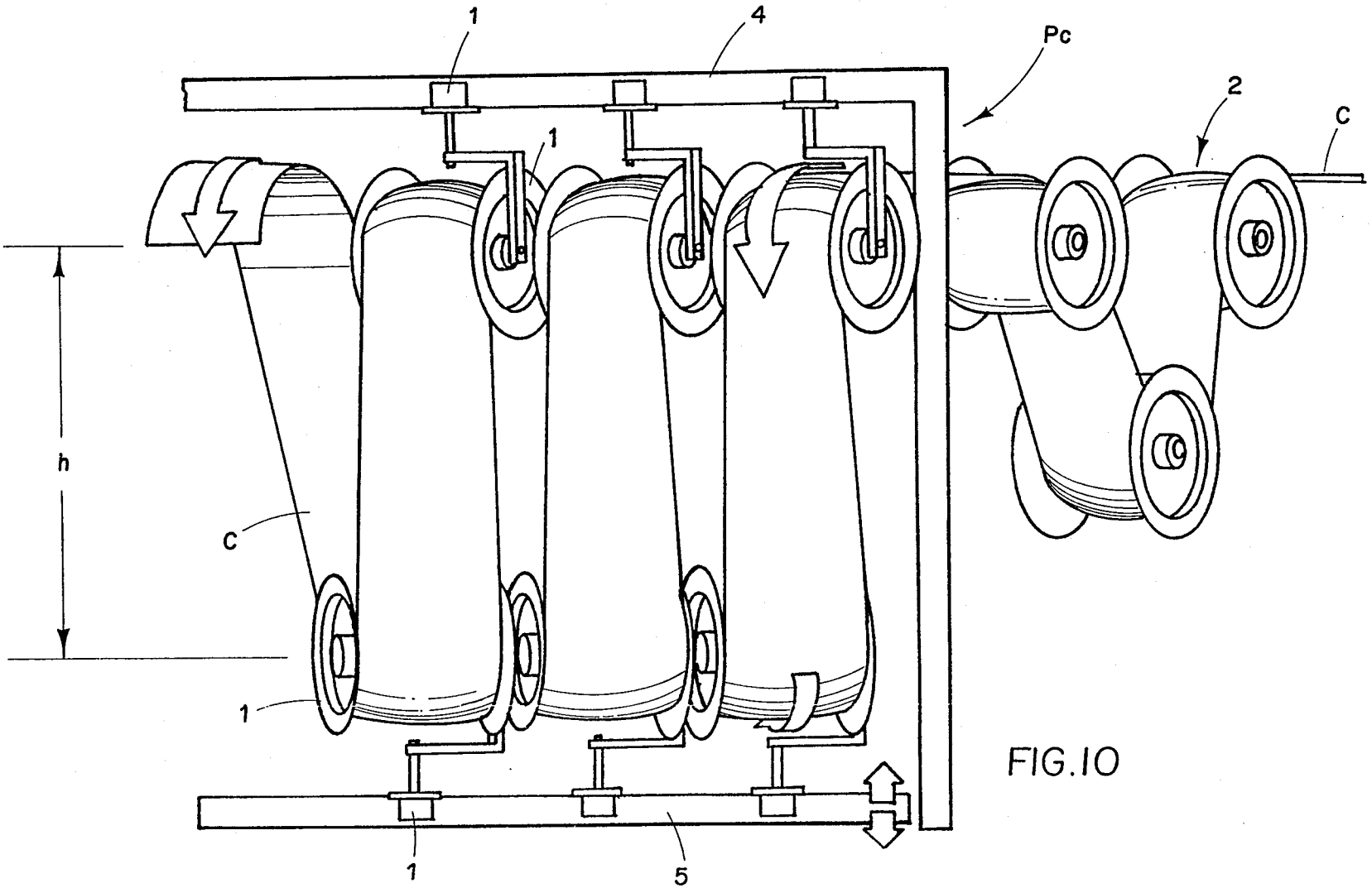
FIG. 10 is an enlarged partial view of an interface unit placed "in-line" in paper processing.
Figure 11:
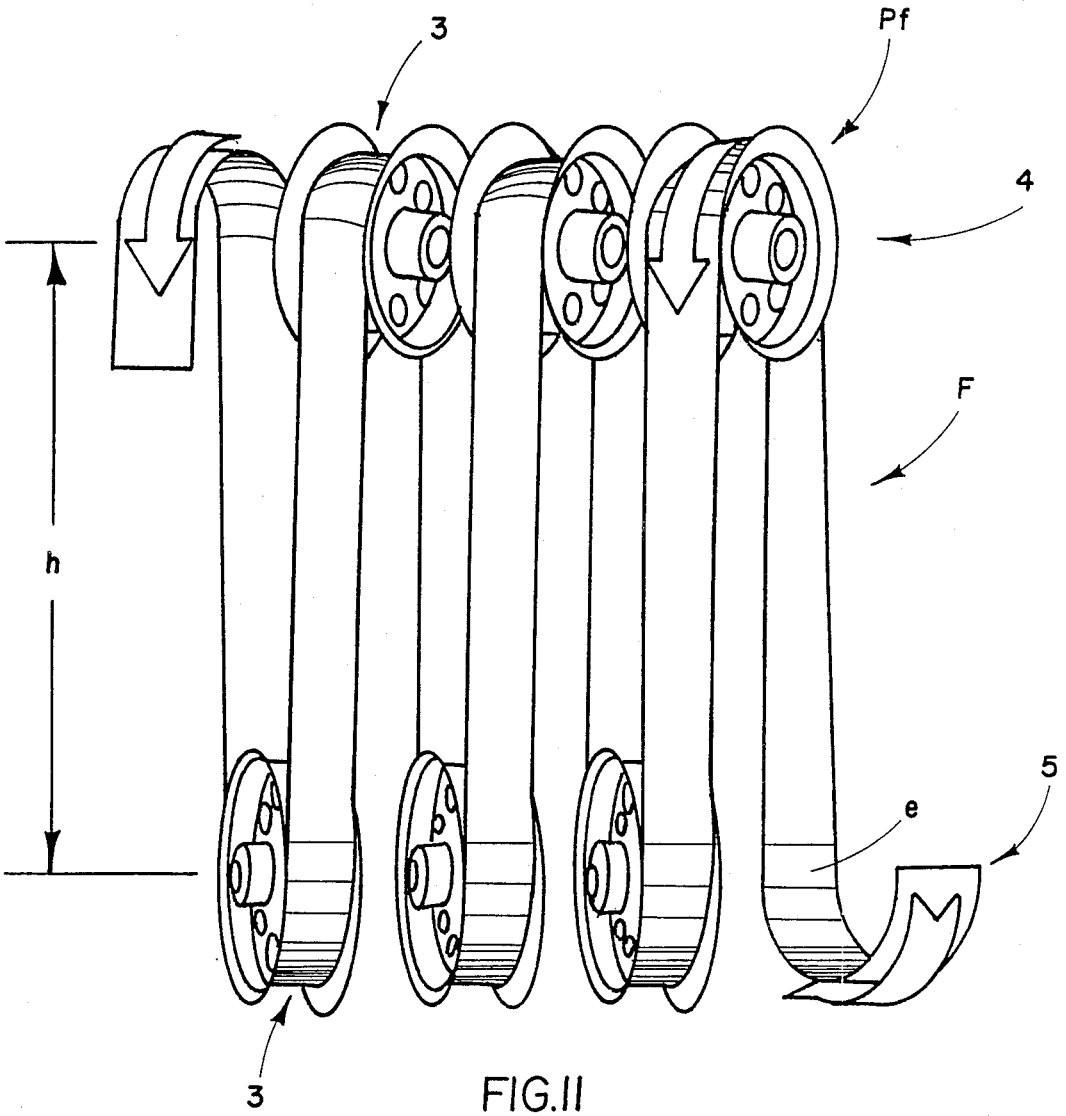
FIG. 11 is an enlarged partial view of an interface unit placed "in-line" in film development.

With additional and particular reference now to FIGS. 10 and 11 the interface units include a frame. A first support platform 4 is positioned in a first plane upon the frame. Preferably, this first support platform 4 is axially, movably fixed on the frame. However, it is to be understood that said first support platform 4 may, alternatively be fixed in place.

A second support platform 5 is positioned in a second plane upon the frame. This second plane (and the second platform 5) is substantially parallel to the first plane (and the first platform 4). Means is provided for movably, slidably fixing the second platform 5 on the frame, for selective axial sliding movement in a first direction either towards the first platform 4 or in a second direction away from the first platform 4.

A plurality of upper pulleys (first pulleys) 1' are fixed in place below the first platform 4. A plurality of lower pulleys (second pulleys) 1 and fixed in place above the second platform 5 and below the first pulleys 1'. Each of the pulleys 1 and 1' has a respective (first and second, respectively) mounting arm. The mounting arms each have a mounting portion, which has a first longitudinal axis that is substantially perpendicular to the first plane. The mounting arms further include a support portion which has a second longitudinal axis which is substantially parallel to the first and second planes and, simultaneously, perpendicular to the first longitudinal axis. A connecting portion extends between the mounting portion and the support portion forming the various portions of the mounting arms as an integral piece.

The mounting portion of each pulley is rotatably journaled in and supported by a respective support platform; the first pulleys 1' being rotatably supported in the first platform 4 and the second pulleys 1 being rotatably supported in the second platform 5. Supported thusly, the pulleys may rotate axially about the respective first longitudinal axis. This permits the pulley 1 and 1' to be axially self-orientable.

Each of said pulleys 1 and 1' has a respective sheave (first sheave and second sheave, respectively) which is rotatably carried on and supported by the support portion thereof for rotational movement about the second longitudinal axis.

The photosensitive material is continuously received in a sheave of one of the first or second pulleys. The material is then serpentinely stretched and wound, on the back surface thereof, on alternating first and second sleeves. By adjusting the space between the first and second platforms 4 and 5 one may "store" excess film for paper C in the interface unit as needed, for example when the units on either side thereof are operating at different speeds. The movement of the photosensitive material through the interface unit Pf, Pc rotates the first and second sheaves about their respective longitudinal axes. The movement of this material further rotatably orients the respective first and second pulleys about the first longitudinal axes thereof.

If desired, a resilient biasing means, such as a tension spring may be secured to one of the support platforms (such as the second platform) for constantly urging that platform away from the other platform. In this fashion, any slackness in the material which may occur as it passes through the unit can be taken up so that the material is maintained tightly wound as it passes therethrough. This further maintains good frictional contact between the photosensitive material and the sheaves.

Preferably, all of the developing and processing units A–I, as well as all of the interface units Pc and Pf are data connected and operationally controlled by one or more controlling data processors, that can control one or more lines. Such controlling data processors are not illustrated but they and their characteristics are well known to those skilled in the art.

Obviously many modifications may be made without departing from the basic spirit of the present invention. Accordingly, it will be appreciated by those skilled in the art that within the scope of the appended claims, the invention may be practiced other than has been specifically described herein.

What is claimed is:

1. An interface unit for a line of a plant having a line for the development and processing of photosensitive materials, said unit comprised of:

a frame having a vertical length;

a first support platform positioned in a first plane on the frame, said first platform having longitudinal and lateral axes;

a second support platform positioned in a second plane on the frame, said second plane being substantially parallel to the first plane in which the first support platform is positioned, said second platform having longitudinal and lateral axes;

means for selectively moving and securing either of the support platforms relative to the other support platform, such that the support platforms may be adjustably, selectively moved in a first vertical direction along the entire vertical length of the frame towards one another, and further such that the support platforms may be selectively moved in a second vertical direction along the entire vertical length of the frame away from one another;

a plurality of first pulleys carried by the first platform, said first pulleys being positioned along both the longitudinal and lateral platform axes, each said first pulley having a first mounting arm including a mounting portion having a first longitudinal axis being substantially perpendicular to the first plane, said first mounting arm further including a support portion having a second longitudinal axis being substantially parallel to the first plane and further being substantially perpendicular to the first longitudinal axis;

the mounting portion of each first pulley being rotatably journaled in and supported by the first support platform for rotational movement about the first longitudinal axis;

said first pulley being positioned along both the longitudinal and lateral platform axes of the first support platform;

each of said first pulleys further having a first sheave rotatably carried on and supported by the support portion thereof for rotational movement about the second longitudinal axis;

a plurality of second pulleys carried by the second platform, said second pulleys being positioned along both the longitudinal and lateral axes, each said second pulley having a second mounting arm including a mounting portion having a first longitudinal axis being substantially perpendicular to the second plane, said second mounting arm of each second pulley further including a support portion having a second longitudinal axis being substantially parallel to the second plane and further being substantially perpendicular to the first longitudinal axis of the mounting portion of the second mounting arm;

the mounting portion of each second pulley being rotatably journaled in and supported by the second support platform for rotational movement about the first longitudinal axis of the mounting portion of the second mounting arm;

said second pulleys being positioned along both the longitudinal and lateral platform axes of the second support platform;

each of said second pulleys further having a second sheave rottably carried on and supported by the support portion of the secoond mounting arm for rotational movement about the second longitudinal axis thereof;

wherein said photosensitive material is continuously received in at least one of the sheaves of both the first and second pulleys and is serpentinely wound on alternating first and second sheaves; and wherein said photosensitive material is continuously received form an up-line unit of the line in any one of the first and second sheaves and is serpentinely wound on any of the alternating first and second sheaves, and further along alternating longitudinal and lateral axes; and further wherein said photosensitive material is continuously passed from one of said first and second sheaves to a down-line unit of the line, whereby a plant having a line for the continuous development and processing of photosensitive materials is provided; and further including means for selectively moving both of the support platforms relative to the other support platform including a resilient biasing means for constantly urging the said support platforms away from one another, whereby the photosensitive material is maintained tightly wound on the sheaves as said material continuously passes through the interface unit.

2. The interface unit of claim !, wherein the continuous movement of the photosensitive material through the interface unit rotates the first and seocnd sheaves about the respective longitudinal axes.

3. The interface unit of claim 1, wherein the continuous movement of the photosensitive material through the interface unit rotatably orients the respective first and second pulleys about the first longitudinal axes thereof.

4. A plant having up-line units and down-line units for the continuous development and processing of photosensitive materials, comprised of:

a preslicing unit for the extraction and preslicing of photosensitive material, whereby a continuous strip of photosensitive material is formed;

a leader magazine unit positioned down-line of the preslicing unit for continuously receiving the continuous strip of photosensitive material therefrom and for continuously feeding the photosensitive material therefrom at a selected speed;

a prechecking unit positioned down-line of the magazine unit for continuously prechecking the continuous material to be processed and developed;

a first interface unit positioned between the magazine unit and the prechecking unit, whereby the photosensitive material being continuously fed form the magazine unit is continuously received and is continuoously passed to the prechecking unit;

a continuous processing unit positioned down-line of the prechecking unit for continuouosly processing the photosensitive material;

a second interface unit positioned between the prechecking unit and the processing unit, whereby the photosensitive material is continuously received from the prechecking unit and is continuously passed to the processing unit;

a notching unit positioned down-line of the processing unit for continuously notching the processed photosensitive material, whereby side hint notches are continuously formed in the photosensitive material;

a third interface unit positioned between the processing unit and the notching unit, whereby the processed photosensitive material is continuously received from the processing unit and is continuously passed to the notching unit;

a printer unit positioned down-line of the notching unit for continuously exposing the photosensitive material to printing paper, whereby prints of the photosensitive material are continuously formed;

a fourth interface unit positioned between the notching unit and the printer unit, whereby the processed, notched photosensitive material is continuously received from the notching unit and is continuously passed to the printer unit;

a printing paper developing unit positioned down-line of the printer unit for continuously developing the prints of the photosensitive material, whereby prints of the photosensitive material are continuously developed;

a fifth interface unit positioned between the printer unit and the developing unit, whereby the prints of the photosensitive material are continuously received from the printer unit and are continuously passed to the developing unit;

an inspection station unit, positioned down-line of the developing unit for continuoously inspectiing the quality of the developed prints of photosensitive material;

a sixth interface unit positioned between the dewveloping unit and the inspecton station unit, whereby the developed prints of photosensitive material are continuously received from the developing unit and are continuously passed to the inspection station unit;

a sorting table unit positioned down-line of the inspection station unit for continuously receiving, classifying, sorting and packing the inspected prints of the photosensitive material; and a seventh interface unit positioined between the inspection station unit and the sorting table unit, whereby the inspected prints of photosensitive material are continuously received from the inspection station unit and are continuously passed to the sorting table unit.

5. The plant of claim 4, wherein each interface unit is comprised of:

a frame;

a first support platform positioned in a first plane on the frame;

a second support platform positioned in a second plane on the frame, said second plane being substantially parallel to the first plane in which the first support platform is positioned;

means for selectively moving at least one of the support platforms relative to the other support platform, such that the support platforms may be selectively moved in a first direction towards one another and further such that the support platforms may be selectively moved in a second direction away from one another;

at least one first pulley, each said first pulley having a first mounting arm including a mounting portion having a first longitudinal axis being substantially perpendicular to the first plane, said first mounting arm further including a support portion having a second longitudinal axis being substantially parallel to the first plane and further being substantially perpendicualr to the first longitudinal axis;

the mounting portion of each first pulley being rotatably journaled in and supported by the first support platform for rotational movement about the first longitudinal axis;

each of said first pulley further having a first sheave rotatably carried on and supported by the support portion thereof for rotational movement about the second longitudinal axis;

at least one second pulley, each said second pulley having a second mounting arm including a mounting portion having a first longitudinal axis being substantially perpendicular to the second plane, said second mounting arm of each second pulley further including a support portion having a second longitudinal axis being substantially parallel to the second plane and further being substantially perpendicular to the first longitudinal axis of the mounting portion of the second mounting arm;

the mounting portion of each second pulley being rotatably journaled in and supported by the second support platform for rotational movement about the first longitudinal axis of the mounting portion of the second mounting arm;

each of said second pulley further having a second sheave rotatably carried on and supported by the support portion of the second mounting arm for rotational movement about the second longitudinal axis thereof;

wherein said photosensitive material is continuously received in a sheave of one of the first and second pulleys and is serpentinely wound on alternating first and second sheaves; and wherein said photosensitive material is continuously received from an up-line unit of the line in one of the first and second sheaves and is serpentinely wound on alternating first and second sheaves, and further wherein said photosensitive material is coninuously passed from one of said first and second sheaves to a down-line unit of line, whereby a plant having a line for the continuous development and processing of photosensitive materials is provided.

6. The plant of claim 5, wherein the continuous movement of the photosensitive material through the interface unit rotates the first and second sheaves about the respective longitudinal axes.

7. The plant of claim 5, wherein the continuous movement of the photosensitive material through the interface unit rotatably orients the respective first and second pulleys about the first longitudinal axes thereof.

8. The plant of claim 5, wherein the means for selectively moving at least one of the support platforms relative to the other support platform includes a resilient biasing means for constantly urging the said support platforms away from one another, whereby the photosensitive material is maintained tightly wound on the sheaves as said material continuously passes through the interface unit.

9. The plant of claim 5, further including a controlling data processor for receiving data from each of the units and further for controlling the operation of each of said units.

10. In a plant for the continuous development and processing of photosensitive material of the type having a line including:

a preslicing unit for the extraction and preslicing of photosensitive material, whereby a continuous strip of photosensitive material is formed;

a leader magazine unit positioned down-line of the preslicing unit for continuously receiving the continuous strip of photosensitive material therefrom and for continuously feeding the photosensitive material therefrom at a selected speed;

a prechecking unit positioned down-line of the magazine unit for prechecking material to be processed and developed;

a continuous processing unit positioned down-line of the prechecking unit for processing the photosensitive material;

a notching unit positionred down-line of the processing unit for notching the processed photosensitive material, whereby side hint notches are formed in the photosensitive material;

a printer unit positioned down-line of the notching unit for exposing the photosensitive material to printing paper, whereby prints of the photosensitive material are formed;

a printing paper developing unit positioned down-line of the printer unit for developing the prints of the photosensitive material, whereby prints of the photosensitive material are developed;

an inspection station unit, positioned down-line of the developing unit for continuously inspecting the quality of the developed prints of photosensitive material; and a sorting table unit positioned down-line of the inspection station unit for continuously receiving, classifying, sorting and packing the inspected prints of the photosensitive material;

the improvcement thereupon comprising:

a first interface unit positioned between the magazine unit and the prechecking unit, whereby the photosensitive material being continuously fed form the magazine unit is continuously received and is continuously passed to the rechecking unit;

a second interface unit positioned between the prechecking unit and the processiing unit, whereby the photosensitive material is continuously received from the prechecking unit and is continuously passed to the processing unit;

a third interface unit positioned between the processing unit and the notching unit, whereby the processed photosensitive material is continbuously received from the processing unit and is continuously passed to the notching unit;

a fourth interface unit positioned between the notching unit and the printer unit, whereby the processed, notched photosensitive material is continuously received from the notching unit and is continuously passed to the printer unit;

a fifth interface unit positioned between the printer unit and the developing unit, whereby the prints of the photosensitive material are continuously received from the printer unit and are continuously passed to the developing unit;

a sixth interface unit positioned between the developing unit and the inspection station unit, whereby the developed prints of photosensitive material are continuously received from the developing unit and are continuously passed to the inspection station unit;

a seventh interface unit positioned between the inspection station unit and the sorting table unit, whereby the inspected prints of photosensitive material are continuously received from the inspection station unit and are continuously passed to the sorting table unit;

wherein a continuous line for the continuous processing and development of the photosensitive material is formed.

11. The plant of claim 10, wherein each interface unit is comprised of:

a frame;

a first suppoort platform positioned in a first plane on the frame;

a secoond support platform positioned in a second plane on the frame, said second plane being substantially parallel to the first plane in which the first support platform is positioned;

means for selectively moving at least one of the support platforms relative to the other support platform, such that the support platforms may be selectively moved in a first directionl towards one another and further such that the support platforms may be selectively moved in a second direction away from one another;

at least one first pulley, each said first pulley having a first mounting arm including a mounting portion having a first longitudinal axis being substantially perpendicular to the first plane, said first mounting arm further including a support portion having a second longitudinal axis being substantially parallel to the first plane and further being substantially perpendicular to the first longitudinal axis;

the mounting portion of each first pulley being rotatably journaled n and supported by the first support platform for rotational movement about the first longitudinal axis;

each of said first pulley further having a first sheave rotatably carried on and supported by the support portion thereof for rotational movement about the second longitudinal axis;

at least one second pulley, each said second pulley having a second mounting arm including a mounting portion having a first longitudinal axis being substantially perpendicular to the second plane, said second mounting arm of each second pulley further including a support portion having a second longitudinal axis beiing substantially parallel to the second plane and further being substantially perpendicular to the first longitudinal axis of the mounting portion of the second mounting arm;

the mounting portion of each second pulley being rotatably journaled in and supported by the second support platform for rotational movement about the first longitudinal axis of the mounting portion of the second mounting arm;

each of said second pulley further having a second sheave rotatably carried on and supported by the support portion of the second mounting arm for rotational movement about the second longitudinal axis thereof;

wherein said photosensitive material is continuously received in a sheave of one of the first and second pulleys and is serpentinely wound on alternating first and second sheaves; and wherein said photosensitive material is continuously received from an up-line unit of the line in one of the first and second sheaves and is serpentinely wound on alternating first and second sheaves, and further wherein said photosensitive material is continuously passed from one of said first and second sheaves to a down-line unit of line, whereby a plant having a line for the continuous development and processing of photosensitive materials is provided.

12. The plant of claim 11, wherein the continuous movement of the photosensitive material through the interface unit rotates the first and second sheaves about the respective longitudinal axes.

13. The plant of claim 11, wherein the continuous movement of the photosensitive material through the interface unit rotatably orients the respective first and second pulleys about the first longitudinal axes thereof.

14. The plant of claim 11, wherein the means for selectively moving at least one of the support platforms relative to the other support platform includes a resilient biasing means for constantly urging the said support platforms away from one another, whereby the photssensitive material is maintained tightly wound on the sheaves as said material continuoously passes through the interface unit.

15. The plant of claim 11, further including a controlling data processor for receiving data from each of the units and further for controlling the operation of each of said units.

* * * * *